US006698734B1

(12) United States Patent
Wang

(10) Patent No.: US 6,698,734 B1
(45) Date of Patent: Mar. 2, 2004

(54) CLAMP ASSEMBLY

(76) Inventor: Ching-Shu Wang, No. 8-5, Lane 433, Ta-Li Rd., Ta-Li, City, Tai-Chung Hsien (TW)

( * ) Notice: Subject to any disclaimer, the term of this patent is extended or adjusted under 35 U.S.C. 154(b) by 0 days.

(21) Appl. No.: 10/352,646

(22) Filed: Jan. 27, 2003

(51) Int. Cl.[7] ..... B25B 5/02

(52) U.S. Cl. ..... 269/6; 269/3; 269/258; 269/266; 269/267; 81/424.5; 81/426.5; 81/426

(58) Field of Search ..... 269/3, 6, 258, 269/265, 266, 267, 268, 269, 270, 261, 264, 43, 156, 49, 87, 228; 81/424.5, 426, 426.5, 418

(56) References Cited

U.S. PATENT DOCUMENTS

| | | | | | |
|---|---|---|---|---|---|
| 4,315,445 | A | * | 2/1982 | Catron | 81/418 |
| 5,680,697 | A | * | 10/1997 | Bever | 29/764 |
| 6,161,823 | A | * | 12/2000 | Bradford | 269/3 |
| 6,327,944 | B1 | * | 12/2001 | Liao | 81/418 |
| 6,431,035 | B1 | * | 8/2002 | Hendrikse et al. | 81/417 |

* cited by examiner

*Primary Examiner*—Joseph J. Hail, III
*Assistant Examiner*—Daniel Shanley
(74) *Attorney, Agent, or Firm*—Charles E. Baxley

(57) ABSTRACT

The present invention discloses a clamp assembly having a pair of clamp handles and a clipping member or a poking member, and the clamp handles use an extendible clamp wire set to control the clipping member or the poking member, so that the tool can be extended into a small narrow operating space for its application.

19 Claims, 10 Drawing Sheets

CLAMP ASSEMBLY

BACKGROUND OF THE INVENTION

1. Field of the Invention

The present invention relates to a hand tool, more particularly to a clamp having a clamping wire set for extending the distance between the handle and the working end of the tool, so that the working end can be extended into the engine chamber of a car or a small narrow space of other machineries for the application of the tool.

2. Description of the Related Art

Various tools such as clamps, wrenches, and the like are used for repairing machineries, and there are lots of wirings and components in the interior of ordinary machines or car engine chamber. Therefore, there are limitations for using ordinary tools in such a limited working space, not only staining the sleeve or clothes by dirty grease, but also having the risk of hurting the user's hand by the mechanical components. Furthermore, some of the repairing position is beyond the reach by the user's hands or hand tools. Therefore, the parts other than those requiring repair are removed first before repairing, and reinstall those parts after the repair is completed. In some cases, we have to disassemble and then assemble the whole set of machine for replacing or adjusting a small part, not only wasting efforts but also wasting lots of time.

SUMMARY OF THE INVENTION

The primary objective of the present invention is to provide a clamp assembly that can be extended into an engine chamber of a car or a small narrow space of other machineries for the application of the tool. The clamp assembly of the present invention can use a clipping member to clip a workpiece, or uses a poling member to poke the objects around the repairing workpiece, which offers a convenient, handy, easy, and convenient way for the repair.

Another objective of the present invention is to provide a clamp assembly that allows users to replace or install the clipping member or poking member on the same clamp handle.

A further objective of the present invention is to provide a clamp assembly having a replaceable clipping member and poking member, so that any single component of the clipping member or the poking member can be replaced when it is damaged. The structural design of the present invention enables users to replace such component quickly and easily.

To accomplish the foregoing objectives, the present invention comprises a pair of clamp handles, wherein one clamp handle has a sliding track, and said sliding track is pivotally couple to a corner of a clamp wire control plate, and both ends of said clamp wire control plate individually coupled to a clamp wire fixing member and pivotally coupled to another clamp handle; a pair of clamp heads are stacked and pivotally coupled with each other, and their rear ends are couple with said clamp handles. A clamp handle torque spring is disposed on one of the clamp head, and a clamp control plate is disposed on another clamp head, and the clamp control plate and the clamp head having a clamp handle torque spring at their corresponding edges each has a ratcheted edge and a ratcheted section engaged with each other. The rear end of the clamp control plate is a poking plate, and the ratcheted edge and ratcheted serration will be separated by pressing the poking plate, and the clamp wire fixing member is coupled with the rear end of the central linear member of a clamp wire set, and the central linear member passes through a protective tube, and its front end is coupled to a clipping member or a poking member. Controlling the extension or contraction of the central linear member of the clamp wire set produces an axial movement and further controls such clipping member or poking member to clip the workpiece or poke the objects around the workpiece.

To make it easier for our examiner to understand the objective of the invention, its structure, innovative features, and performance, we use a preferred embodiment together with the attached drawings for the detailed description of the invention.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
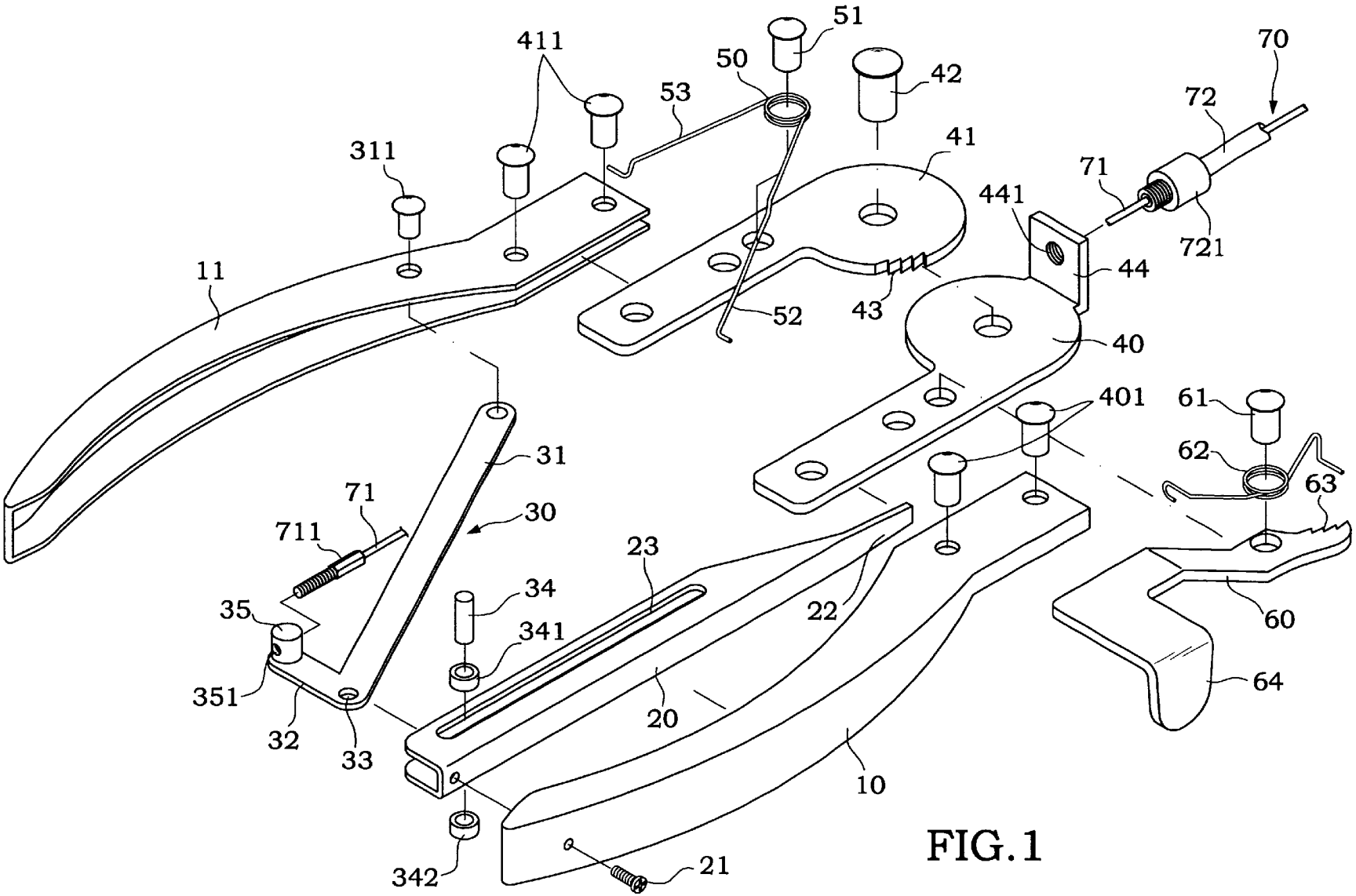
FIG.1 is a perspective diagram of the disassembled parts of the clamp handle, clamp head, and their related structure in accordance with the present invention.
Figure 2:
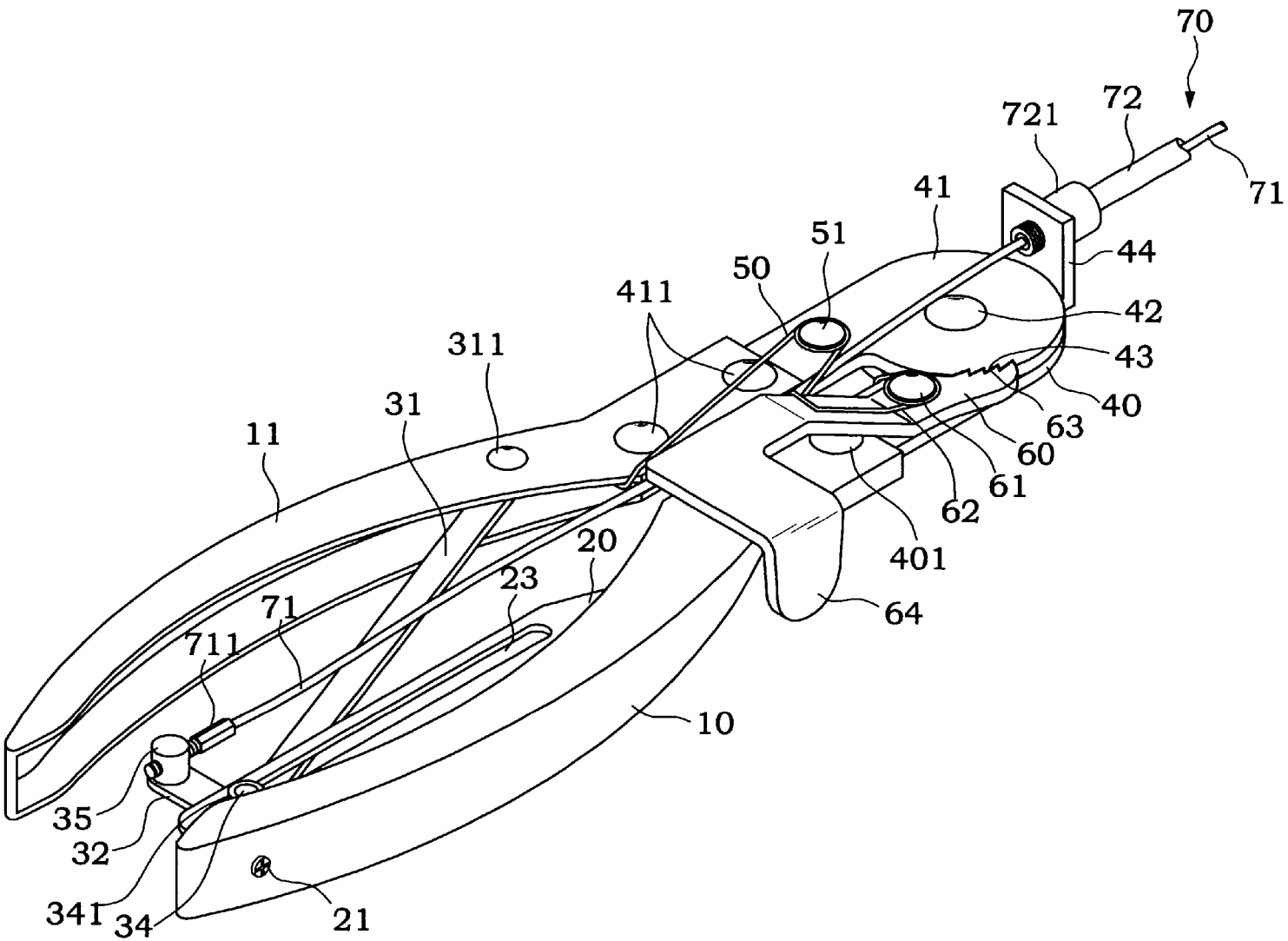
FIG. 2 is a perspective diagram of the assembled parts according to FIG. 1.
Figure 3:
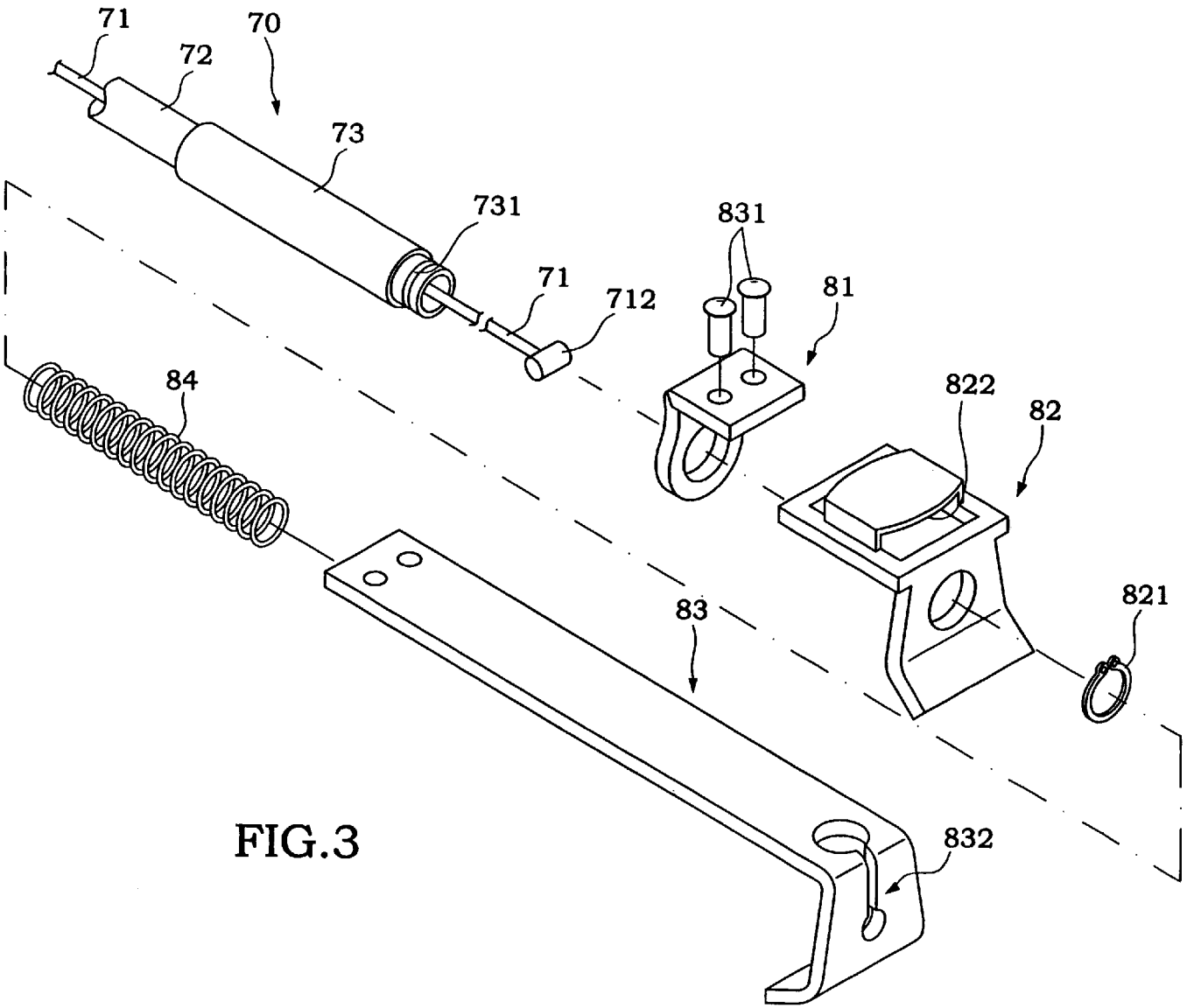
FIG. 3 is a perspective diagram of the clipping member structure of the present invention.

Please refer to FIGS. 1 and 2 for a clamp assembly of the present invention comprising:

- a first clamp handle 10 and a second clamp handle 11, said pair of clamp handles 10, 11 being hollow inside and open on their corresponding sides;
- a sliding track 20, being a long hollow bar structure, and both ends of said sliding track 20 along the direction of the long axis of the first clamp handle 10 being fixed inside the first clamp handle 10, and the rear end of said sliding track 20 is set into the interior of the first clamp handle 10, and the front end is a fixed end in the shape of a flat plate, and a sliding hole is disposed each on the upper and lower sections of said sliding track 20;
- a clamp wire control bracket 30, being a plate structure substantially in the shape of a hook, having a long arm 31 and a short arm 32, and a through hole 33 being disposed at the comer where said long and short arms 31, 32 intersect, and said comer being disposed inside said sliding track 20 and a movable wedge 34 passing through the sliding hole 23 and pivotally coupled into the through hole 33; said movable wedge 34 passes through and extends outside the upper and lower ends of said sliding track 20 to press against a metal lubricated positioning ring 341, 342 so that the movable wedge 34 can freely rotate in the holes without the risk of falling off from the sliding hole 23 and the through hole 33; an open end of said long arm 31 uses a pivotal coupling member 311 to movably coupled to the interior of the second clamp handle 11, and an open end of said short arm 32 having a clamp wire fixing member 35; and a threaded hole 351 penetrating through said clamp wire fixing member 35 in the radial direction;

a first and a second clamp heads 40, 41, each having a rear end in the form of a plate structure and being fixed to the front end of the first and second clamp handles 10, 11 respectively by a plurality of fixtures 401, 411; and the rear end of the first clamp head 40 even blocks the adjacent side of the fixed end 22 in the flat plate, such that the fixed end 22 is restricted between the inner wall of the first clamp handle 10 and the rear end of the first clamp head without the risk of moving outward or falling off. The heads of the first and second clamp heads 40, 41 are the corresponding protruded circular plate structure, stacking and pivotally coupled with each other by a movable member 42, so that the first and second clamp heads 40, 41 drive the first and second clamp handles 10, 11 to open and close by using the movable member 42 as the axle; furthermore, a ratcheted section 43 being disposed on the arc edge of the second clamp head 41; a clamp wire plate 44 being disposed at the turning head section of the first clamp head 41; and a threaded hole 441 disposed on the clamp wire plate 44; a clamp handle torque spring 50, pivotally coupled on the structural surface of the second clamp head 41 by a fixture 51, having two spring legs 52, 53 separately pressing against and being fixed on the first and second clamp handles 10, 11; and the elasticity of the torque spring 50 provides the tension for opening the first and second clamp handles 10, 11;

a clamping control plate 60, passing through a torque spring 62 and pivotally coupled on the structural surface of the first clamp head 40 with a pivotal member 61 (such as a rivet); said torque spring 62 having one end fixed on the clamping control plate 60, and the other end fixed on the first clamp head 40; said clamping control plate 60 at its front end having a ratcheted edge 63 engaged with the ratcheted section 43 of the second clamp head 41; the elasticity of the torque spring 62 provides the force for engaging the ratcheted edge 63 in normal condition to the ratcheted section of the clamp head 41; said clamping control plate 60 at the rear end defining a poking plate 64 bent outward; said poking plate 64 presses towards the direction of the first clamp handle 10 such that said two ratcheted edges 63, 64 are separated to coil the torque spring 62 and the ratcheted serration of the ratcheted section 43 and ratcheted edge 63 can slide alternately when moving in the positive direction and be latched when moving in the opposite direction;

a clamp wire set 70 as shown in FIG. 3, comprising a central linear member 71, having one end coupled to a threaded fixture 711, and the other end coupled to a fixed head 712; said central linear member 71 passing through a hollow elastic protective tube 72, and one end of said protective tube 72 has a threaded fixture 721 and the other end pressing and passing through a positioning sleeve 73 as shown in FIG. 3, and the open end of said positioning sleeve 73 has a latch ring groove 731; the fixture 711 at the rear end of the central linear member 71 being coupled into the threaded hole 351 of the clamp wire fixing member 35 ; the threaded fixture 721 at the rear end of said protective tube 72 being fixed into the threaded hole 441 of the clamp wire plate 44;

a workpiece control set as shown in FIGS. 3, 4, 6, and 7, could be in the form of either a clipping member 80 or a poking member 90, coupled at the front end of said clamp wire set 70, being a structure capable of performing the opening and closing movement by the central linear member 71.

Figure 4:
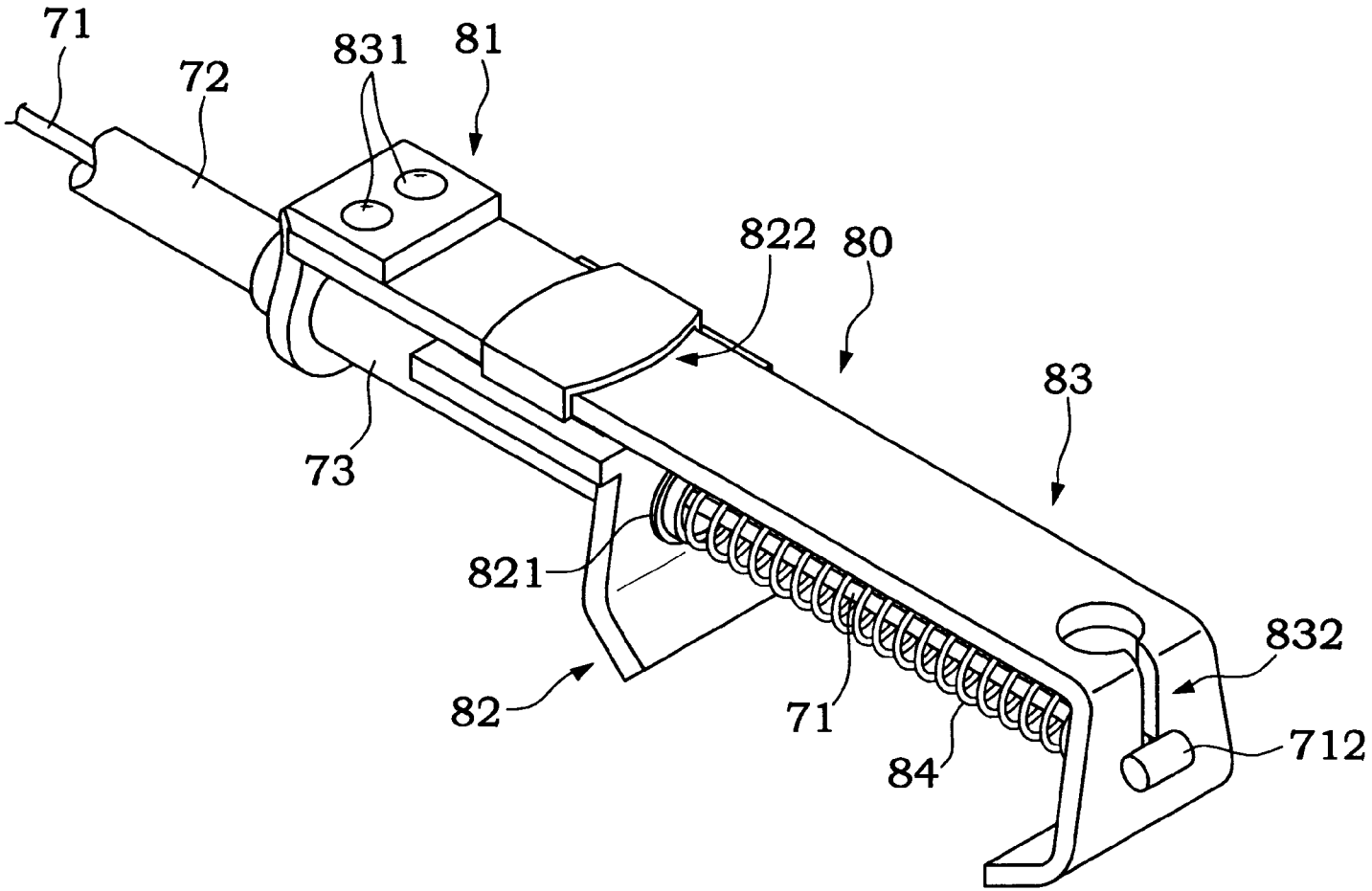
FIG. 4 is a perspective diagram of the assembled structure according to FIG.

As shown in FIGS. 3 and 4, said clipping member 80 comprises:

a L-shaped fixing plate 81, for enabling the body of said positioning sleeve 73 to be pivotally coupled and passing through the lower section thereof;

a first L-shaped clipping member 82, for enabling the end of said positioning sleeve 73 having a latch ring groove 731 with one end pivotally coupled and passing through the lower section thereof and being latched into a fixed position by a C-shaped ring 821; a space 822 being defined at the upper section of said first L-shaped clamping member 82;

a second L-shaped clipping member 83, comprising an extended upper plate structure passing through the space 822 of the first clipping member 82, and one end of said L-shaped clipping member 83 being fixed to the upper section of said fixing plate 81 by a fixture 831, and said second clipping member 83 having a fixed hole 832 for letting the fixing head 712 of the central linear member 71 to pass through and be fixed into a position;

a spring 84, disposed between said first and second clipping members 82, 83 and outside said central linear member 71.

Figure 6:
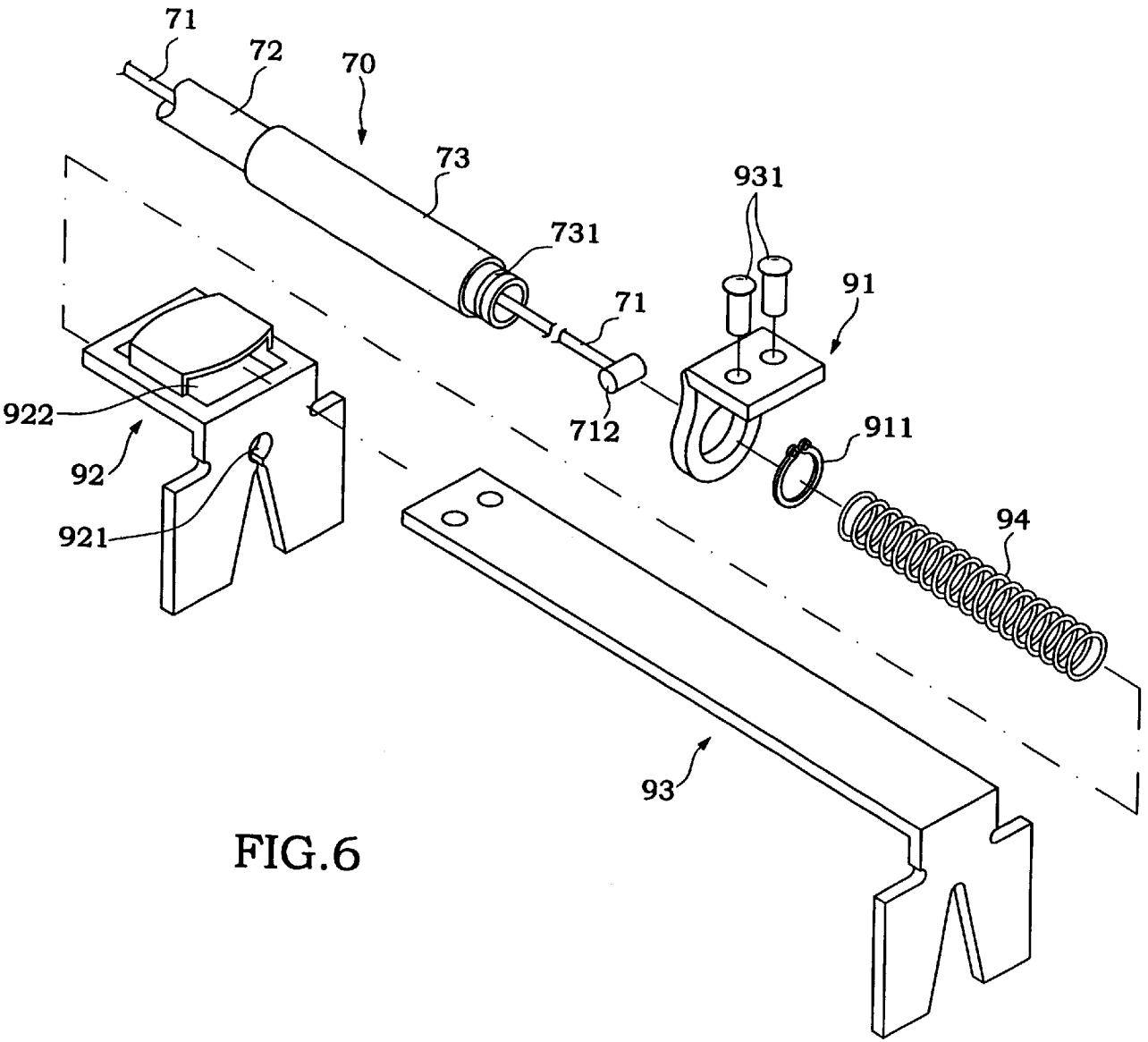
FIG. 6 is a perspective diagram of the disassembled parts of the poking member structure of the present invention.
Figure 7:
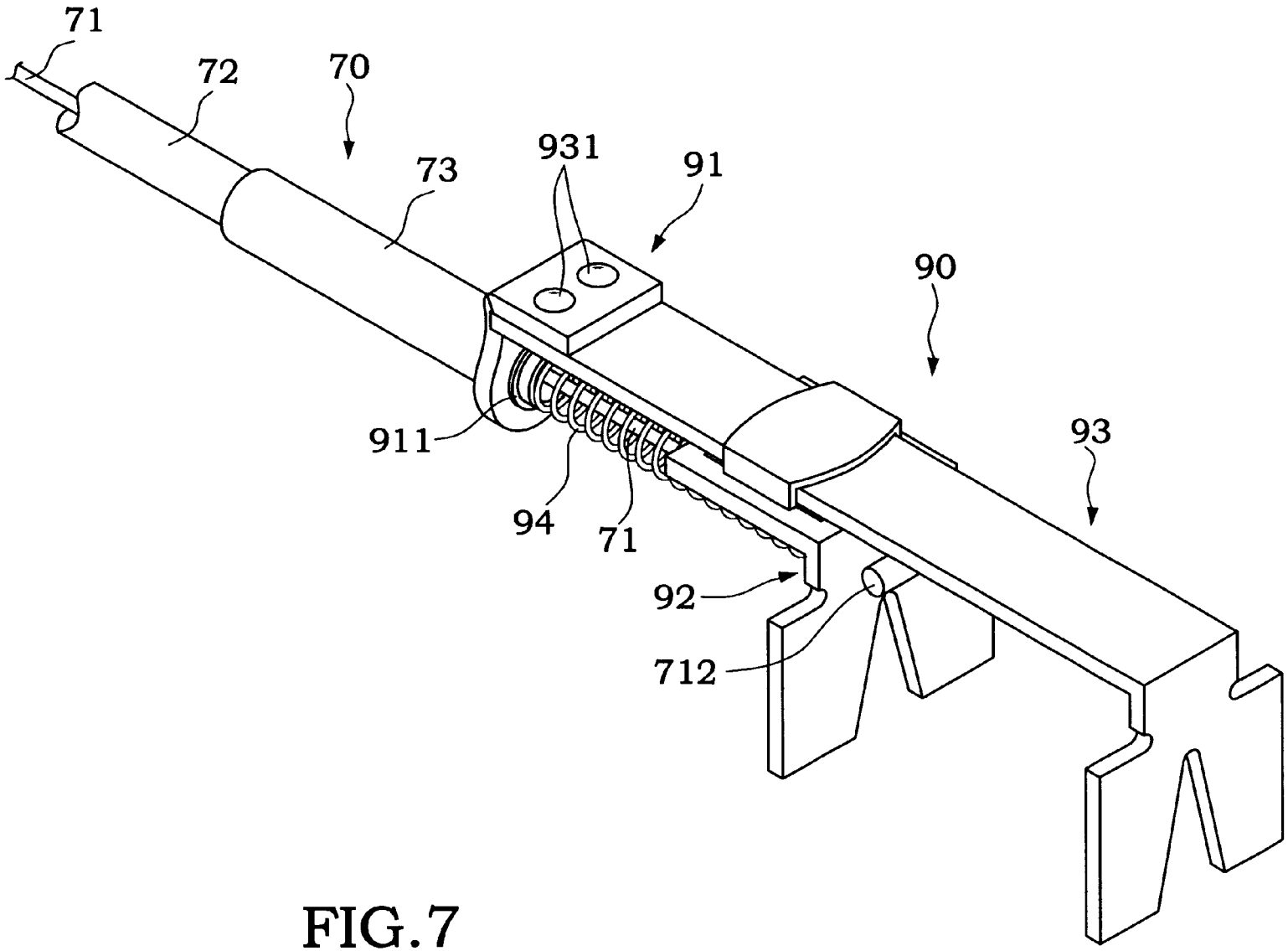
FIG. 7 is a perspective diagram of the assembled structure in accordance with FIG. 6.

As shown in FIGS. 6 and 7, said poking member 90 comprises:

a L-shaped fixing plate 91, for enabling one end of said positioning sleeve 73 having a latch ring groove 731 pivotally coupled and passing through the lower section thereof and be fixed into a position by a C-shaped latch ring 911;

a first L-shaped poking member 92, having a fixing hole 921 for enabling the fixing head 712 of said central linear member 71 to pass through and be latched in a fixed position; a space 922 being defined at the upper section of said first L-shaped clipping member 92;

a second L-shaped poking member 93, comprising an extended upper plate structure passing through the space 922 of the first poking member 92, and one end of said L-shaped poking member 93 being fixed to the upper section of said fixing plate 91 by a fixture 931;

a spring 94, disposed between said first and first poking members 92, and the fixing plate 91 outside said central linear member 71.

After knowing the structure of the present invention, we will further describe the operation and movement of the present invention as follows:

The user generally operates the first and second clamp handles 10, 11 to attain the purpose of controlling the opening of the clipping member 80 or the poking member 90; the clipping member is closed to clip a workpiece and opened to release a workpiece; the poking member is opened to poke the objects surrounding a workpiece.

Figure 5A:
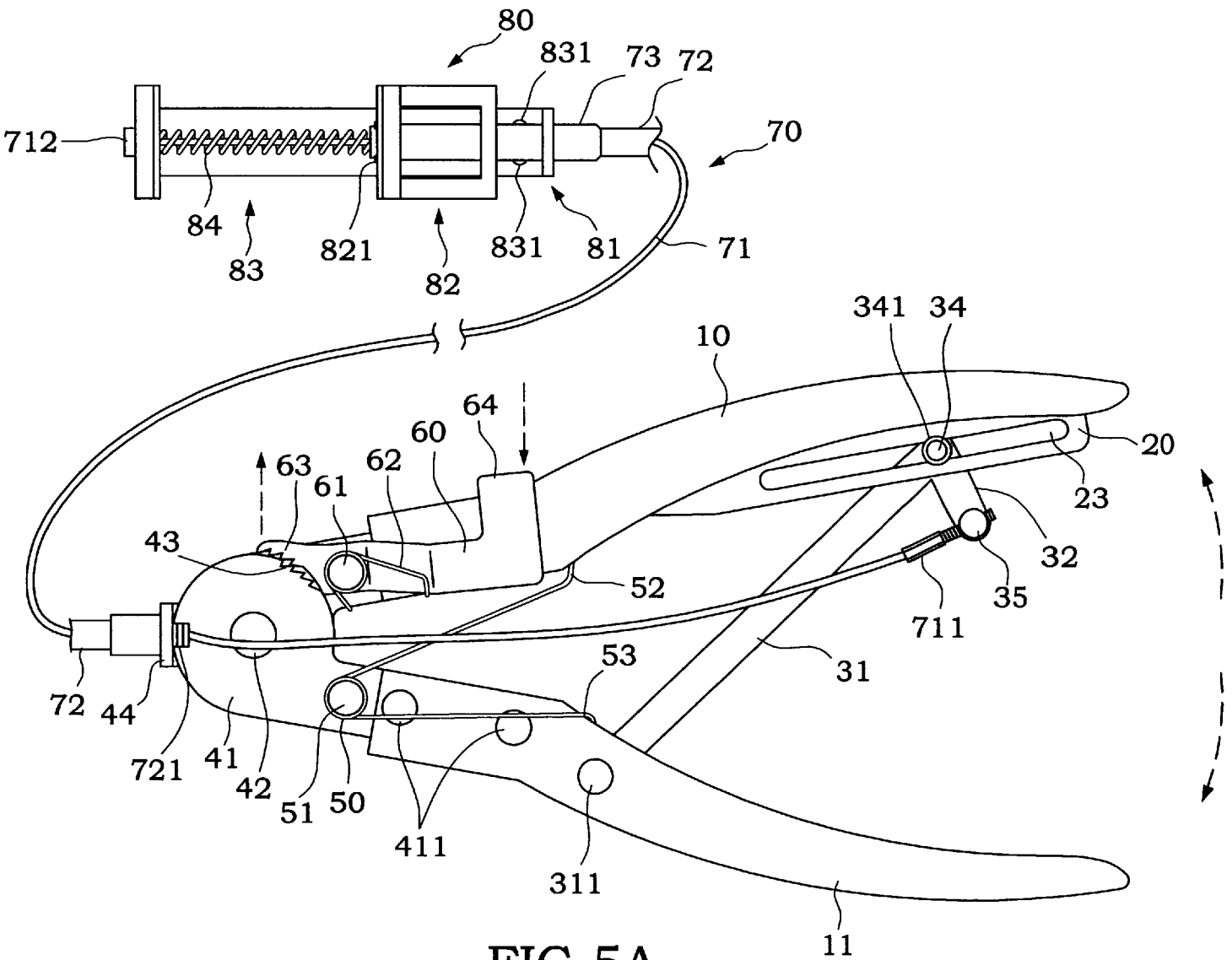
FIG. 5A is an illustrative diagram of the planar movement of the clamp handle control clipping member according to the present invention.
Figure 5B:
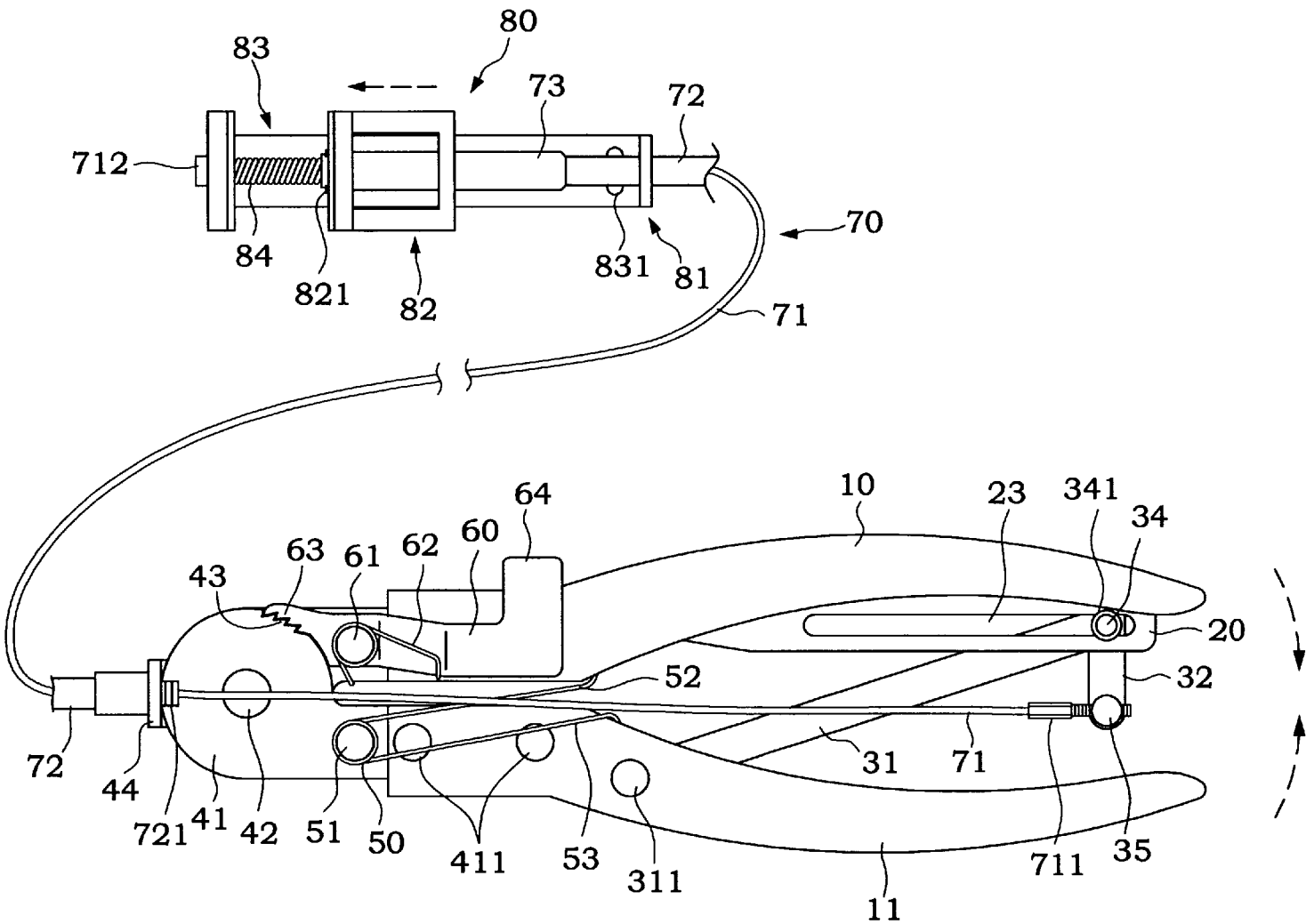
FIG. 5B is another illustrative diagram of the planar movement of the clamp handle control clipping member according to the present invention.

In FIG. 5B, the user exerts forces on the first and second clamp handles 10, 11 by gripping them, the ratcheted section 43 of the second clamp head 41 and the ratcheted edge 63 of the clamp control plate 60 produces a alternate ratchet phenomenon and sound due to the sliding in the positive direction, and the clamp wire control plate 30 swings towards the second clamp handle 11 by sing the pivotal member 311 of its long arm 31 as a hinge, and such swing converts into a force on the sliding wedge 34 to drive the corner of the clamp wire control plate 30 to move towards the end of said sliding hole 23, and said clamp wire fixing member also moves back and further pull the central linear member 71. The front end of the central linear member 71 pulls the second clipping member 83 of the clipping member 80, and the first and second clipping members 82, 83 use said sliding space 822 to produce the corresponding movement and compress the spring 84 to achieve the control of clipping the workpiece. In FIG. 8B, if the first and second clamp handles 10, 11 work with the poking member 90, then the central linear member 71 is pulled while the first poking plate 92 is pulled so that the first and second poking plates 92, 93 are separated to achieve the purpose of poking the objects surrounding the workpiece.

When the clipping member 80 has clipped the workpiece or the poking member 90 has poked the object to a predetermined distance, the user can gently grip the first and second clamp handles 10, 11. Although a tension is exerted on the first and second clamp handles 10, 11, the reaction on the ratchet section 43 and the ratcheted edge 63 of the first and second clamp heads 40, 41 is in a latch situation in the opposite direction, therefore the first and second clamp handles 10, 11 will be fixed in a predetermined clamping angle without the risk of spring apart.

Figure 8A:
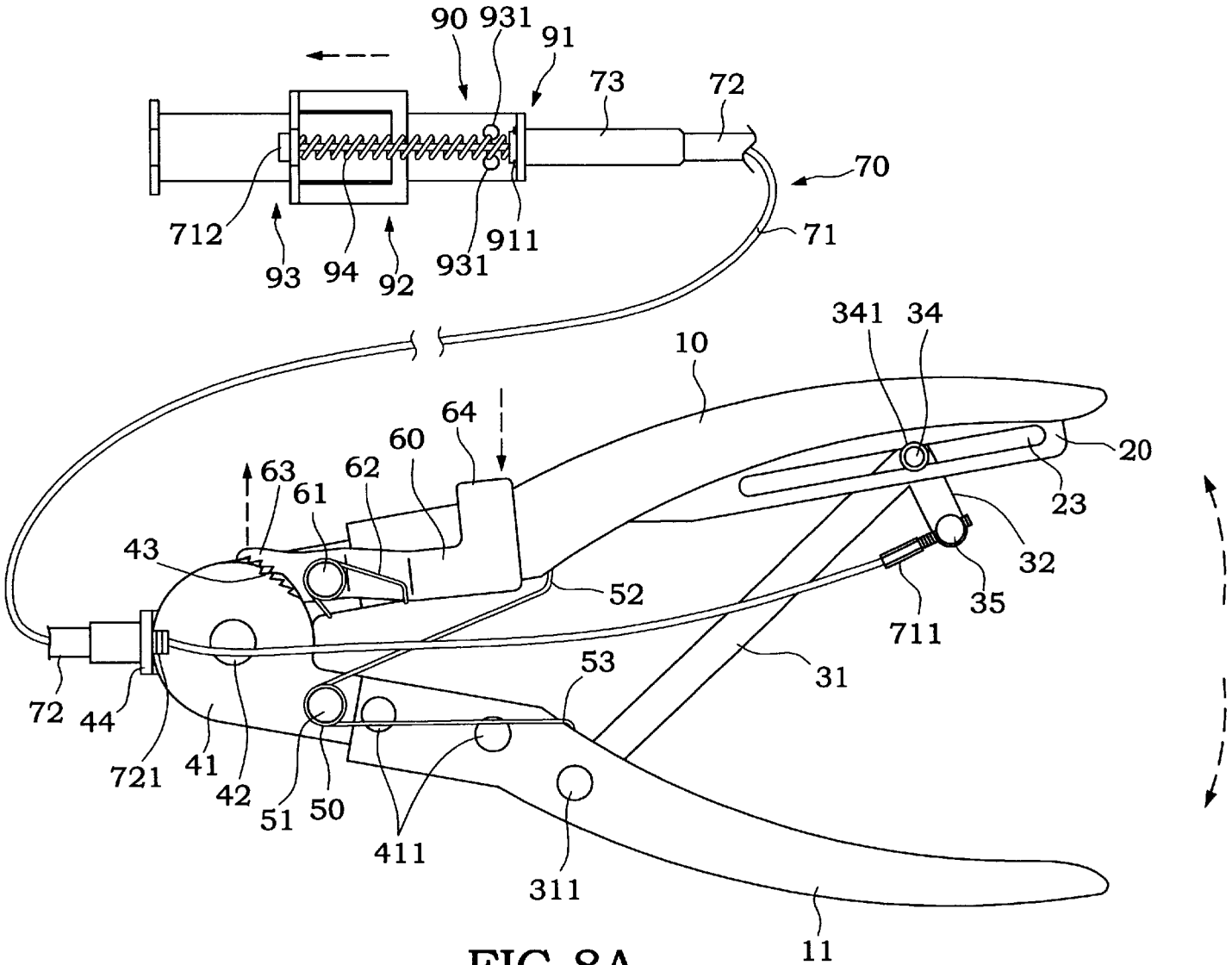
FIG. 8A is an illustrative diagram of the planar movement of the clamp handle control poking member according to the present invention.
Figure 8B:
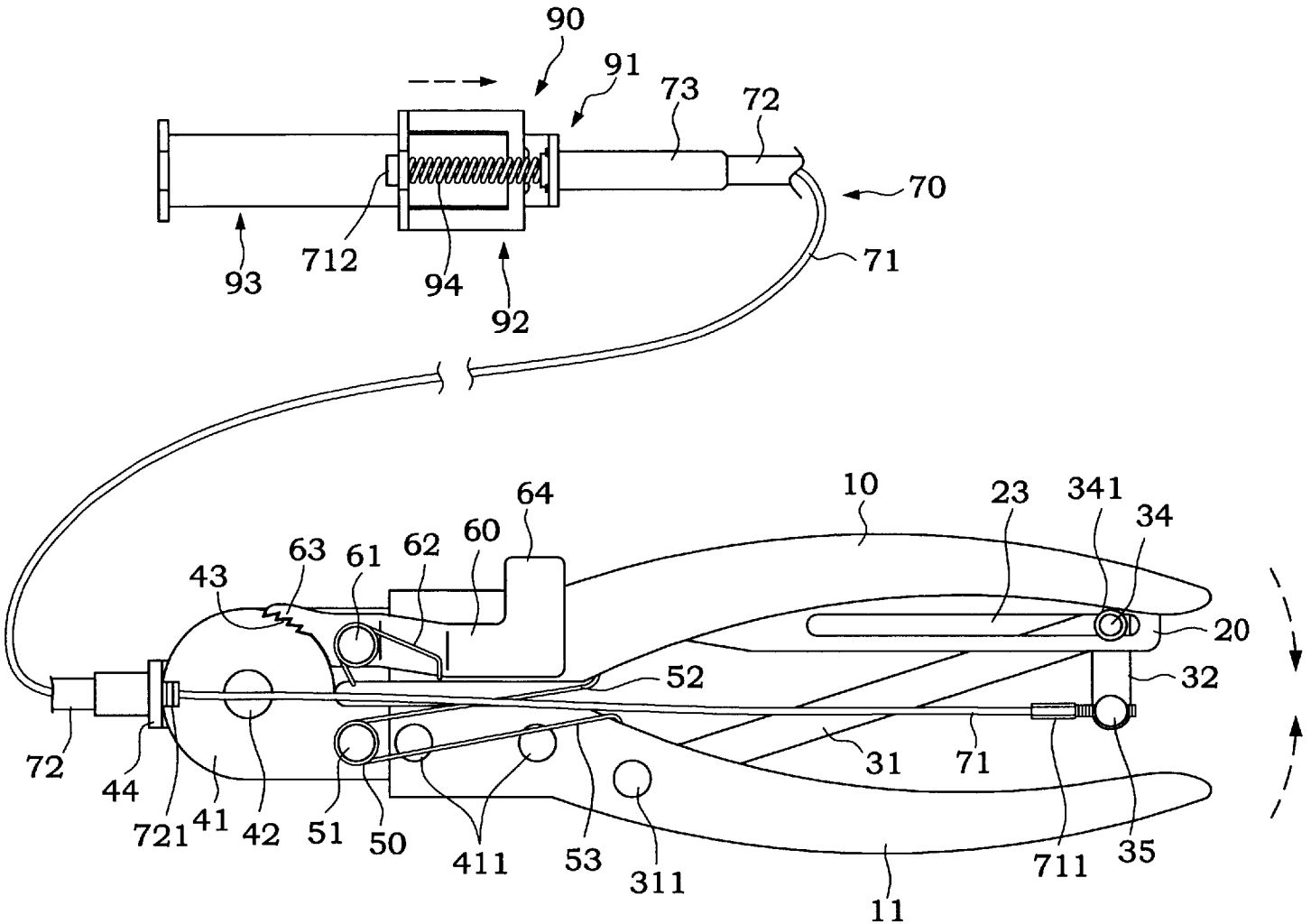
FIG. 8B is another illustrative diagram of the planar movement of the clamp handle control poking member according to the present invention.

In FIGS. 5A and 8A, if the user wants to release the workpiece from the clipping member 80 or the object around the workpiece from the poking member 90, the user must press the poking plate 64 of the clamp control plate 60 in the direction towards the first clamp handle 10 so that the ratcheted edge and the ratcheted section 43 are separated, and the first and second clamp handles 10, 11 lose the latching force. The clamp handle torque spring 50 and the spring 84, 94 of the clipping member 80 or poking member 90 also lose the coiling or compression, both restore their positions. Particularly, the spring 84, 90 of the clipping member 80 or the poking member 90 restores its position to drive the second clipping member 83 or the first poking plate 92 to restore the position such that the clipping member 80 or the poking member 90 restores its original opening status while pulling the central linear member 71 to move forward. The central linear member 71 also pulls the clamp fixing member 35 to use the sliding wedge 34 at its corner to move to the front of the sliding hole 23 such that the clamp control plate swings outward in the direction towards the first clamp handle 10, and the first and second clamp handles 10, 11 will automatically open.

The present invention uses a clamp wire set 70 to extend the distance between the handle of the tool to the working end, so that the tool can be extended into a small narrow operating space that the user's hand or regular tools cannot reach. The flexibility of the clamp wire set 70 allows the tool of the present invention to pass through the curve and turning in the space easily. The user can control the grip of the first and second clamp handles 10, 11 to control the clipping member 80 to clip the workpiece or the poking member 90 to poke the objects around the workpiece. The operation is simple and handy. If the user wants to release the workpiece, the user just needs to press the poking plate 64 to open the first and second clamp handles 10, 11 while restoring the clipping member 80 or poling member to the original opening status. The operation is also simple, handy, easy and convenient.

In addition, the clipping member 80 and poking member 90 of the present invention can work together with a clamp wire set 70 and uses the threaded fixture 721 of the protective sleeve 72 to couple with the threaded hole 4541 of the clamp wire plate 711, and the threaded fixture 711 of the central linear member 71 to couple with the threaded hole 351 of the clamp wire fixing member 35 to quickly install the clipping member 80 or the poking member 90 on the same clamp handle. The clipping member 80 and the poking member 90 are the replaceable components. When a component fails, it can be replaced. For replacing a component, the C-shape latch ring 821, 911 and the fixture 831, 931 are removed to release the coupling of the components, and thus achieving the purpose of replacing components quickly.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

What is claimed is:

1. A clamp assembly, comprising:

a first clamp handle and a second clamp handle, said pair of clamp handles being hollow inside and open on their corresponding sides;

a sliding track, being a long hollow bar structure, and both ends of said sliding track along the direction of the long axis of the first clamp handle being fixed inside the first clamp handle, and a sliding hole in the same direction as the long axis being disposed on each of an upper section and a lower section of said sliding track;

a clamp wire control bracket, being a plate structure substantially in the shape of a hook, having a long arm and a short arm, and a through hole being disposed,at the corner where said long and short arms intersect, and said corner being disposed inside said sliding track, and a movable wedge passing through the sliding hole and pivotally coupled into the through hole;

an open end of said long arm being movably coupled to the interior of the second clamp handle and an open end of said short arm having a clamp wire fixing member;

a first and a second clamp heads, each having its rear end fixed to the front end of the first and second clamp handles respectively, and the head of said first and second clamp heads stacking and pivotally coupled with each other by a movable member, and a ratcheted section being disposed on the edge of the second clamp head; a clamp wire plate being disposed at the turning head section of the first clamp head;

a clamp handle torque spring, pivotally coupled on the structural surface of the second clamp head by a fixture, having two spring legs separately pressing against and being fixed on the first and second clamp handles;

a clamping control plate, passing through a torque spring and pivotally coupled on the structural surface of the first clamp head ; said torque spring having one end fixed on the clamping control plate, and the other end fixed on the first clamp head; said clamping control plate at its front end having a ratcheted edge engaged with the ratcheted section of the second clamp head, and said clamping control plate at the rear end defining a poking plate bent outward;

a clamp wire set, comprising a central linear member passing through a hollow elastic protective tube, and a rear end of said central linear member being fixed to said clamp wire fixing member; the rear end of said protective tube being fixed to the clamp wire plate, and the front end being sleeved by a positioning sleeve;

a workpiece control set, coupled at one end of said positioning sleeve, and disposed at the front end of said clamp wire set, being a structure displaceable axially and capable of performing the opening and closing movement by the central linear member.

2. The clamp assembly of claim 1, wherein said workpiece control set is a clipping member, and said clipping member comprises:

a L-shaped fixing plate, for enabling the body of said positioning sleeve to be pivotally coupled and passing through the lower section thereof;

a first L-shaped clipping member, for enabling the end of said positioning sleeve to be pivotally coupled and passing through the lower section thereof and being latched into a fixed position by a C-shaped ring; a space being defined at the upper section of said first L-shaped clamping member; a second L-shaped clipping member, comprising an extended upper plate structure passing through the space of the first clipping member, and one end of said L-shaped clipping member being fixed to the upper section of said fixing plate, and the lower section of said second clipping member being fixed with the front end of said central linear member; a spring, disposed between said first and second clipping members and passing through said central linear member to the outside.

3. The clamp assembly of claim 2, wherein said second clipping member at its lower section has a fixed hole, and said central linear member at its front end has a protruded fixed head such that said fixed hole receiving and latching said fixed head in a fixed position.

4. The clamp assembly of claim 2, wherein said workpiece control set is a poking member, and said poking member comprises:

a L-shaped fixing plate, for enabling the body of said positioning sleeve to be pivotally coupled and passing through the lower section thereof;

a first L-shaped poking member, for enabling the end of said positioning sleeve to be pivotally coupled and passing through the lower section thereof and being latched into a fixed position by a C-shaped ring; a space being defined at the upper section of said first L-shaped clamping member;

a second L-shaped poking member, comprising an extended upper plate structure passing through the space of the first poking member, and one end of said L-shaped poking member being fixed to the upper section of said fixing plate, and the lower section of said second poking member being fixed with the front end of said central linear member;

a spring, disposed between said first and second poking members and passing through said central linear member to the outside.

5. The clamp assembly of claim 4, wherein said first poking member at its lower section has a fixed hole, and said central linear member at its front end has a protruded fixed head such that said fixed hole receiving and latching said fixed head in a fixed position.

6. The clamp assembly of claim 1, wherein said clamp wire fixing member at its radial direction has a threaded hole, and said central linear member at its rear end has a threaded fixture, and said threaded fixture passes through and latches into said threaded hole such that the rear end of the central linear member couples with said clamp wire fixing member.

7. The clamp assembly of claim 1, wherein said clamp wire plate has a threaded hole, and said clamp wire set at the rear end of the protective tube has a threaded fixture, and said threaded fixture passes through and latches into said threaded hole such that the rear end of the protective tube is coupled to said clamp wire plate.

8. The clamp assembly of claim 1, wherein said movable wedges of the clamp wire control plate passes through the upper and lower ends of said sliding track and presses against a lubricate metal positioning ring.

9. The clamp assembly of claim 1, wherein said ratcheted edge of the clamp wire control plate slides alternately with the ratcheted section of the second clamp head while moving in the same direction of ratcheted movement and the clamp wire control plate is latched while moving in the opposite direction.

10. A clamp assembly, comprising:

a first clamp handle and a second clamp handle, said pair of clamp handles being hollow inside and open on their corresponding sides;

a sliding track, being a long hollow bar structure, and both ends of said sliding track along the direction of the long axis of the first clamp handle being fixed inside the first clamp handle, and a sliding hole in the same direction as the long axis being disposed on each of an upper section and a lower section of said sliding track;

a clamp wire control bracket, being a plate structure substantially in the shape of a hook, having a long arm and a short arm, and a through hole being disposed at the corner where said long and short arms intersect, and said corner being disposed inside said sliding track, and a movable wedge passing through the sliding hole and pivotally coupled into the through hole;

an open end of said long arm being movably coupled to the interior of the second clamp handle and an open end of said short arm having a clamp wire fixing member;

a first and a second clamp heads, each having its rear end fixed to the front end of the first and second clamp handles respectively, and the head of said first and second clamp heads stacking and pivotally coupled with each other by a movable member, and a ratcheted section being disposed on the edge of the second clamp head; a clamp wire plate being disposed at the turning head section of the first clamp head;

a clamp handle torque spring, pivotally coupled on the structural surface of the second clamp head by a fixture, having two spring legs separately pressing against and being fixed on the first and second clamp handles;

a clamping control plate, passing through a torque spring and pivotally coupled on the structural surface of the first clamp head ; said torque spring having one end fixed on the clamping control plate, and the other end fixed on the first clamp head; said clamping control plate at its front end having a ratcheted edge engaged with the ratcheted section of the second clamp head, and said clamping control plate at the rear end defining a poking plate bent outward;

a clamp wire set, comprising a central linear member passing through a hollow elastic protective tube, and a rear end of said central linear member being fixed to said clamp wire fixing member; the rear end of said protective tube being fixed to the clamp wire plate, and the front end being sleeved by a positioning sleeve;

a clipping member, comprising a L-shaped fixing plate and its lower section being pivotally coupled to the body of said positioning sleeve; a L-shaped fixing plate, for enabling the body of said positioning sleeve to be pivotally coupled and passing through the lower section thereof;

a first L-shaped clipping member, for enabling the end of said positioning sleeve to be pivotally coupled and passing through the lower section thereof and being latched into a fixed position by a C-shaped ring; a space being defined at the upper section of said first L-shaped clamping member;

a second L-shaped clipping member, comprising an extended upper plate structure passing through the space of the first clipping member, and one end of said L-shaped clipping member being fixed to the upper section of said fixing plate, and the lower section of said second clipping member being fixed with the front end of said central linear member;

a spring, disposed between said first and second clipping members and passing through said central linear member to the outside.

11. The clamp assembly of claim 10, wherein said second clipping member at its lower section has a fixed hole, and said central linear member at its front end has a protruded fixed head such that said fixed hole receiving and latching said fixed head in a fixed position.

12. The clamp assembly of claim 10, wherein said clamp wire fixing member at its radial direction has a threaded hole, and said central linear member at its rear end has a threaded fixture, and said threaded fixture passes through and latches into said threaded hole such that the rear end of the central linear member couples with said clamp wire fixing member.

13.The clamp assembly of claim 10, wherein said clamp wire plate has a threaded hole, and said clamp wire set at the rear end of the protective tube has a threaded fixture, and said threaded fixture passes through and latches into said threaded hole such that the rear end of the protective tube is coupled to said clamp wire plate.

14. The clamp assembly of claim 10, wherein said ratcheted edge of the clamp wire control plate slides alternately with the ratcheted section of the second clamp head while moving in the same direction of ratcheted movement and the clamp wire control plate is latched while moving in the opposite direction.

15. A clamp assembly, comprising:

a first clamp handle and a second clamp handle, said pair of clamp handles being hollow inside and open on their corresponding sides;

a sliding track, being a long hollow bar structure, and both ends of said sliding track along the direction of the long axis of the first clamp handle being fixed inside the first clamp handle, and a sliding hole in the same direction as the long axis being disposed on each of an upper section and a lower section of said sliding track;

a clamp wire control bracket, being a plate structure substantially in the shape of a hook, having a long arm and a short arm, and a through hole being disposed at the corner where said long and short arms intersect, and said corner being disposed inside said sliding track, and a movable wedge passing through the sliding hole and pivotally coupled into the through hole;

an open end of said long arm being movably coupled to the interior of the second clamp handle and an open end of said short arm having a clamp wire fixing member;

a first and a second clamp heads, each having its rear end fixed to the front end of the first and second clamp handles respectively, and the head of said first and second clamp heads stacking and pivotally coupled with each other by a movable member, and a ratcheted section being disposed on the edge of the second clamp head; a clamp wire plate being disposed at the turning head section of the first clamp head;

a clamp handle torque spring, pivotally coupled on the structural surface of the second clamp head by a fixture, having two spring legs separately pressing against and being fixed on the first and second clamp handles;

a clamping control plate, passing through a torque spring and pivotally coupled on the structural surface of the first clamp head; said torque spring having one end fixed on the clamping control plate, and the other end fixed on the first clamp head; said clamping control plate at its front end having a ratcheted edge engaged with the ratcheted section of the second clamp head, and said clamping control plate at the rear end defining a poking plate bent outward;

a clamp wire set, comprising a central linear member passing through a hollow elastic protective tube, and a rear end of said central linear member being fixed to said clamp wire fixing member; the rear end of said protective tube being fixed to the clamp wire plate, and the front end being sleeved by a positioning sleeve;

a poking member, comprising a L-shaped fixing plate and its lower section being pivotally coupled to the body of said positioning sleeve; a L-shaped fixing plate, for enabling the body of said positioning sleeve to be pivotally coupled and passing through the lower section thereof;

a first L-shaped poking member, for enabling the end of said positioning sleeve to be pivotally coupled and passing through the lower section thereof and being latched into a fixed position by a C-shaped ring; a space being defined at the upper section of said first L-shaped clamping member;

a second L-shaped poking member, comprising an extended upper plate structure passing through the space of the first clipping member, and one end of said L-shaped poking member being fixed to the upper section of said fixing plate, and the lower section of said second poking member being fixed with the front end of said central linear member;

a spring, disposed between said first and second clipping members and passing through said central linear member to the outside.

16. The clamp assembly of claim 10, wherein said second clipping member at its lower section has a fixed hole, and said central linear member at its front end has a protruded fixed head such that said fixed hole receiving and latching said fixed head in a fixed position.

17. The clamp assembly of claim 15, wherein said clamp wire fixing member at its radial direction has a threaded hole, and said central linear member at its rear end has a threaded fixture, and said threaded fixture passes through and latches into said threaded hole such that the rear end of the central linear member couples with said clamp wire fixing member.

18. The clamp assembly of claim 15, wherein said clamp wire plate has a threaded hole, and said clamp wire set at the rear end of the protective tube has a threaded fixture, and said threaded fixture passes through and latches into said threaded hole such that the rear end of the protective tube is coupled to said clamp wire plate.

19. The clamp assembly of claim 15, wherein said ratcheted edge of the clamp wire control plate slides alternately with the ratcheted section of the second clamp head while moving in the same direction of ratcheted movement and the clamp wire control plate is latched while moving in the opposite direction.

* * * * *

US006698734C1

(12) EX PARTE REEXAMINATION CERTIFICATE (5494th)

United States Patent
Wang

(10) Number: US 6,698,734 C1
(45) Certificate Issued: Sep. 5, 2006

(54) CLAMP ASSEMBLY

(75) Inventor: Ching-Shu Wang, No. 8-5, Lane 433, Ta-Li Rd., Ta-Li, City, Tai-Chung Hsien (TW)

(73) Assignee: Ching-Shu Wang, Tai-Chung Hsien (TW)

Reexamination Request:
No. 90/007,570, Jun. 3, 2005

Reexamination Certificate for:

| | |
|---|---|
| Patent No.: | **6,698,734** |
| Issued: | **Mar. 2, 2004** |
| Appl. No.: | **10/352,646** |
| Filed: | **Jan. 27, 2003** |

(51) Int. Cl.
*B25B 5/02* (2006.01)

(52) U.S. Cl. ..... 269/6; 269/3; 269/258; 269/266; 269/267; 81/424.5; 81/426.5; 81/426

(58) Field of Classification Search ..... 269/6
See application file for complete search history.

(56) References Cited

U.S. PATENT DOCUMENTS

| | | | |
|---|---|---|---|
| 6,161,823 | A | 12/2000 | Bradford |
| 6,370,985 | B1 | 4/2002 | Wu |
| 6,698,734 | B1 | 3/2004 | Wang |

FOREIGN PATENT DOCUMENTS

| | | |
|---|---|---|
| TW | 517625 | 1/2003 |

*Primary Examiner*—Beverly M. Flanagan

(57) ABSTRACT

The present invention discloses a clamp assembly having a pair of clamp handles and a clipping member or a poking member, and the clamp handles use an extendible clamp wire set to control the clipping member or the poking member, so that the tool can be extended into a small narrow operating space for its application.

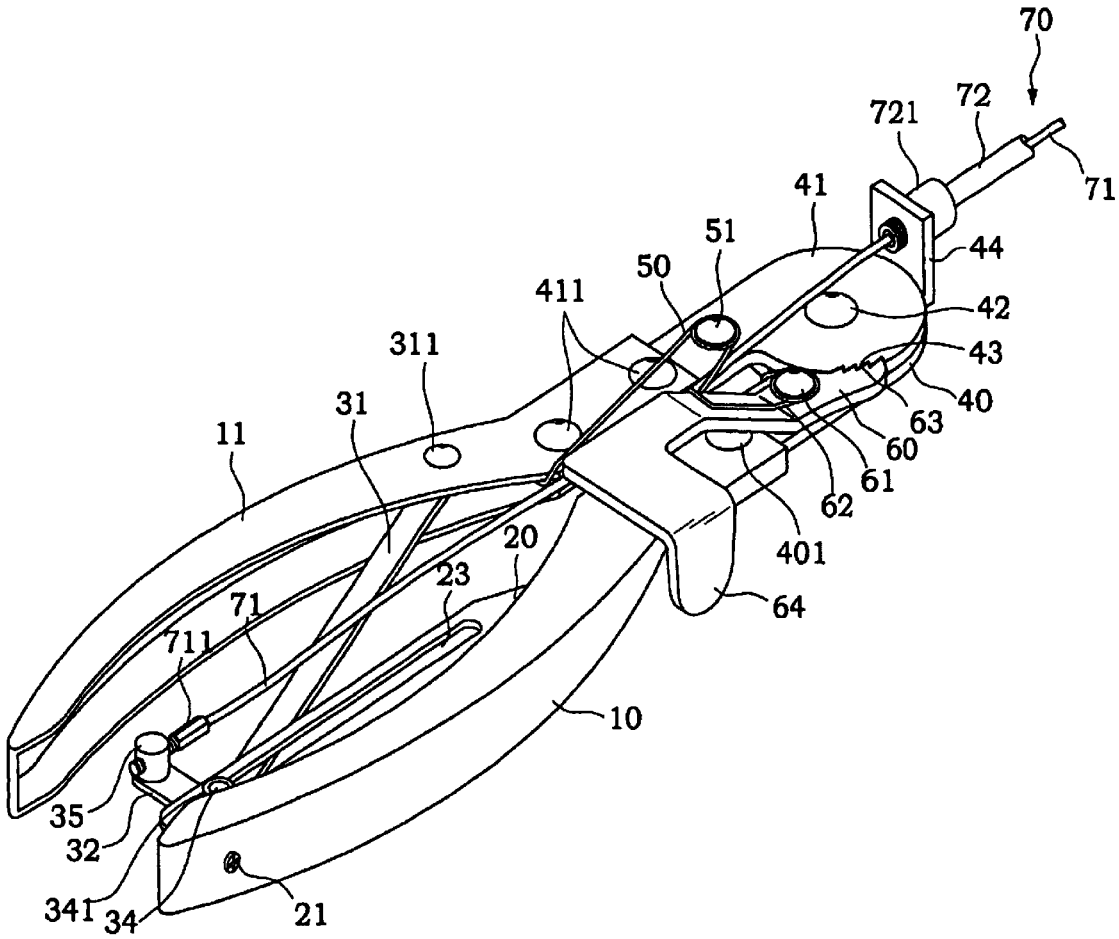

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–19 is confirmed.

* * * * *